US009478346B2

(12) United States Patent
Nakata et al.

(10) Patent No.: US 9,478,346 B2
(45) Date of Patent: Oct. 25, 2016

(54) COIL COMPONENT

(71) Applicant: PANASONIC CORPORATION, Osaka (JP)

(72) Inventors: Toshiyuki Nakata, Osaka (JP); Tomonori Shibuya, Mie (JP); Nobuya Matsutani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 143 days.

(21) Appl. No.: 14/352,254

(22) PCT Filed: Dec. 20, 2012

(86) PCT No.: PCT/JP2012/008160
§ 371 (c)(1),
(2) Date: Apr. 16, 2014

(87) PCT Pub. No.: WO2013/094209
PCT Pub. Date: Jun. 27, 2013

(65) Prior Publication Data

US 2014/0253274 A1 Sep. 11, 2014

(30) Foreign Application Priority Data

Dec. 22, 2011 (JP) ..... 2011-280931

(51) Int. Cl.
*H01F 27/02* (2006.01)
*H01F 27/29* (2006.01)
(Continued)

(52) U.S. Cl.
CPC ..... *H01F 27/025* (2013.01); *H01F 27/06* (2013.01); *H01F 27/255* (2013.01)

(58) Field of Classification Search
CPC .... H01F 27/025; H01F 27/255; H01F 27/06; H01F 27/02
USPC ..... 336/92, 82, 83, 90, 59, 192
See application file for complete search history.

(56) References Cited

U.S. PATENT DOCUMENTS 6,198,373 B1 * 3/2001 Ogawa ..... H01F 17/0033 336/83
6,786,772 B1 * 9/2004 Liu ..... H01R 24/64 439/541.5

(Continued)

FOREIGN PATENT DOCUMENTS

CN 1783370 6/2006
CN 101335129 12/2008

(Continued)

OTHER PUBLICATIONS

International Search Report issued in International Application No. PCT/JP2012/008160 mailed Apr. 9, 2013, with English translation, 4 pgs.

(Continued)

*Primary Examiner* — Elvin G Enad
*Assistant Examiner* — Kazi Hossain
(74) *Attorney, Agent, or Firm* — McDermott Will & Emery LLP

(57) ABSTRACT

A coil component includes a magnetic core, a coil-wire portion wound on the magnetic core, and a case made of a resin covering the magnetic core and the coil-wire portion. The magnetic core is made of a pressed magnetic material powder and forms a closed magnetic circuit. The magnetic core has a lower surface configured to contact a mounting surface. The case has a lower surface configured to contact the mounting surface. The lower surface of the magnetic core includes an exposed-core portion exposed from the case. The exposed-core portion is flush with the lower surface of the case. This coil component enhances the efficiency of heat dissipation.

25 Claims, 11 Drawing Sheets

(51) Int. Cl.
*H01F 27/06* (2006.01)
*H01F 27/255* (2006.01)

(56) References Cited

U.S. PATENT DOCUMENTS

| | | | | |
|---|---|---|---|---|
| 2004/0145438 | A1* | 7/2004 | Yeh | F23Q 3/00 336/90 |
| 2007/0052510 | A1* | 3/2007 | Saegusa | H01F 27/022 336/92 |
| 2007/0205856 | A1* | 9/2007 | Matsunaga | H01F 17/0013 336/200 |
| 2010/0237972 | A1* | 9/2010 | Yen | H01F 27/06 336/65 |
| 2011/0006870 | A1* | 1/2011 | Sakamoto | H01F 1/26 336/221 |
| 2011/0115593 | A1* | 5/2011 | Liao | H01F 27/02 336/90 |
| 2012/0092120 | A1 | 4/2012 | Yoshikawa et al. | |
| 2012/0146759 | A1* | 6/2012 | Shibuya | H01F 17/043 336/221 |
| 2013/0038415 | A1 | 2/2013 | Ooishi et al. | |

FOREIGN PATENT DOCUMENTS

| | | | |
|---|---|---|---|
| JP | 09-115744 | A | 5/1997 |
| JP | 2003-007547 | A | 1/2003 |
| JP | 2003007547 | * | 1/2003 |
| JP | 2004-039888 | A | 2/2004 |
| JP | 2006-066683 | A | 3/2006 |
| JP | 2009-218532 | A | 9/2009 |
| JP | 2010-171209 | A | 8/2010 |
| WO | 2010/110007 | A1 | 9/2010 |
| WO | 2011/132361 | A1 | 10/2011 |

OTHER PUBLICATIONS

English Translation of Chinese Search Report dated Jan. 29, 2016 for the related Chinese Patent Application No. 201280062998.7.

* cited by examiner

COIL COMPONENT

RELATED APPLICATIONS

This application is the U.S. National Phase under 35 U.S.C. §371 of International Application No. PCT/JP2012/008160, filed on Dec. 20, 2012, which in turn claims the benefit of Japanese Application No. 2011-280931, filed on Dec. 22, 2011, the disclosures of which are incorporated by reference herein.

TECHNICAL FIELD

The present invention relates to a coil component for use in various electronic devices.

BACKGROUND ART

FIGS. 9 and 10 are a perspective view and an exploded perspective view of conventional coil component 500 described in Patent Literature 1, respectively. As shown in FIG. 10, middle legs 5 of split magnetic cores 4 are inserted in through-hole 3 of bobbin 2 having coil-wire portion 1 wound thereon. The periphery of them is covered with resin in this state as shown in FIG. 9, thereby forming case 6. This configuration stabilizes the positional relation between elements constituting coil component 500.

FIG. 11A is a bottom view of coil component 500. FIG. 11B is a sectional view of coil component 500. In coil component 500, split magnetic cores 4 are exposed partially to the outside of case 6. This configuration can suppress deterioration of thermal characteristics caused by sealing with case 6 that can exert a negative effect, that is, deterioration of magnetic and electrical characteristics resulting from self-heating of the coil component. This configuration facilitates dissipation of the heat generated in coil-wire portion 1 and split magnetic cores 4 to the outside of the coil component.

CITATION LIST

Patent Literature

Patent Literature 1: Japanese Patent Laid-Open Publication No. 09-115744

SUMMARY

A coil component includes a magnetic core, a coil-wire portion wound on the magnetic core, and a case made of a resin covering the magnetic core and the coil-wire portion. The magnetic core includes a middle leg, an outer leg, and a connecting rod that connects the middle leg and the outer leg. The magnetic core is made of a pressed magnetic material powder and forms a closed magnetic circuit. The coil-wire portion is wound on the middle leg of the magnetic core. The magnetic core has a lower surface configured to contact a mounting surface. The case has a lower surface configured to face the mounting surface. The lower surface of the magnetic core has an exposed-core portion exposed from the case. The exposed-core portion is flush with the lower surface of the case.

The coil component may include a supporting layer disposed on the lower surface of the magnetic core. In this case, the exposed-core portion does not necessarily be flush with the lower surface of the case.

This coil component enhances the efficiency of heat dissipation.

DETAIL DESCRIPTION OF PREFERRED EMBODIMENT

Figure 1:
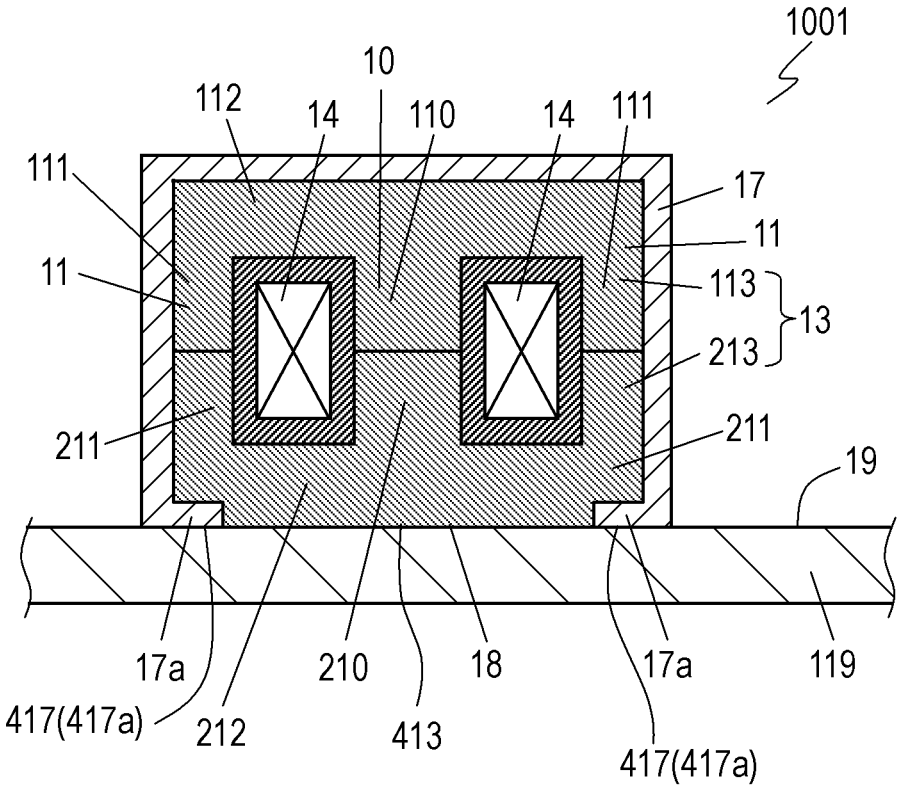
FIG. 1 is a sectional view of a coil component in accordance with an exemplary embodiment.
Figure 2:
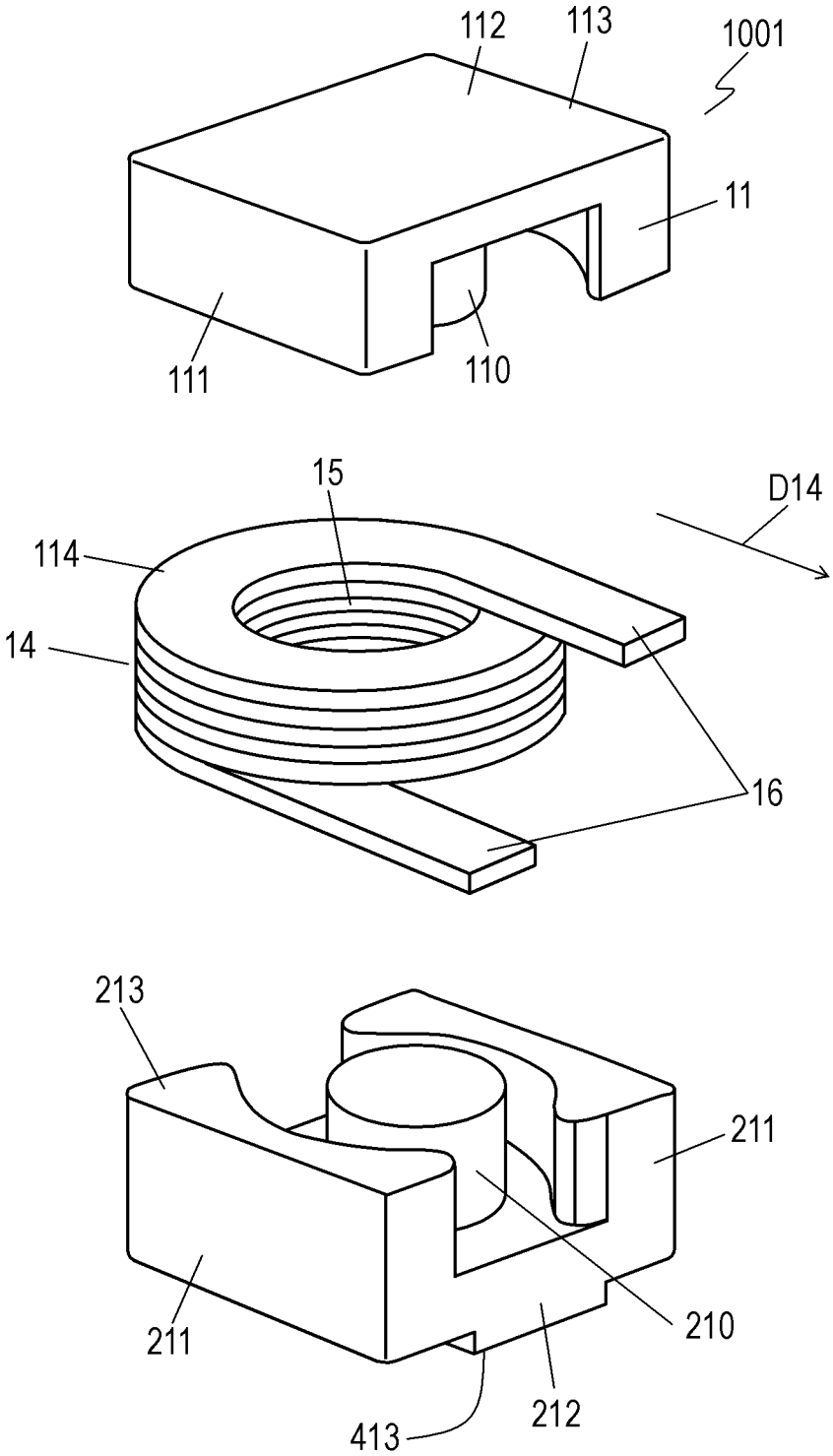
FIG. 2 is an exploded perspective view of the coil component in accordance with the embodiment.

FIGS. 1 and 2 are a perspective view and an exploded perspective view of coil component 1001 in accordance with an exemplary embodiment. Coil component 1001 includes magnetic core 13, coil-wire portion 14 wound on magnetic core 13, and case 17 that seals magnetic core 13 and coil-wire portion 14. Magnetic core 13 includes middle leg 10, outer legs 11 disposed at both sides of middle leg 10, and connecting rods 112 and 212 that connect middle leg 10 and outer legs 11. Magnetic core 13 includes split magnetic cores 113 and 213 each of which is made of a pressed magnetic material powder formed by pressing a soft magnetic material. Split magnetic core 113 includes split middle leg 110, split outer legs 111 disposed at both sides of split middle leg 110, and connecting rod 112 that connects split middle leg 110 and split outer legs 111. Split magnetic core 213 includes split middle leg 210, split outer legs 211 disposed at both sides of split middle leg 210, and connecting rod 212 that connects split middle leg 210 and split outer legs 211. An upper surface of split middle leg 210 is joined to a lower surface of split middle leg 110 so as to form middle leg 10. Upper surfaces of split outer legs 211 are joined to lower surfaces of split outer legs 111 so as to form outer legs 11. Coil-wire portion 14 is made of conductive wire 114 wound about hollow part 15, and has external connecting parts 16, both ends of conductive wire 114. Middle leg 10 is inserted into hollow part 15 of coil-wire portion 14, and split magnetic cores 113 and 213 are joined from both sides of coil-wire portion 14, thereby forming a closed magnetic circuit. External connecting parts 16 are drawn out in direction D14 from a side at which outer legs 11 of magnetic core 13 are not located. As shown in FIG. 1, case 17 entirely seals magnetic core 13 and coil-wire portion 14 from the outer surface of magnetic core 13 to the periphery of coil-wire portion 14 except for a part of lower surface 413 of magnetic core 13 (split magnetic core 213). Middle leg 10 (split middle leg 210) and outer legs 11 (split outer legs 211) extend upward from connecting rod 212.

Split magnetic cores 113 and 213 have E-shapes formed of split middle legs 110 and 210, split outer legs 111 and 211, and connecting rods 112 and 212, respectively. Middle leg 10 and outer legs 11 of magnetic core 13 may be split in another form. For instance, One of split magnetic cores 113 and 213 has an E-shape formed of middle leg 10, outer legs 11, and connecting rod 112 (212), and the other of split magnetic cores 113 and 213 has an I-shape formed of connecting rod 112 (212).

Case 17 includes case bottom portions 17*a* extending along lower surface 413 of magnetic core 13 (split magnetic core 213). Case bottom portion 17*a* is located under outer legs 11. Lower surface 417*a* of case bottom portion 17*a* of case 17 contacts mounting surface 19.

Coil component 1001 is mounted onto mounting surface 19 such that lower surface 413 of magnetic core 13 and lower surfaces 417 of case bottom portions 17*a* of case 17 contact mounting surface 19 of mounting board 119. Lower surface 413 of magnetic core 13 has exposed-core portion 18. Exposed-core portion 18 is exposed without being covered with case 17 and contacts mounting surface 19. Exposed-core portion 18 and lower surface 417 of case 17 are flush with each other. Exposed-core portion 18 and lower surface 417 of case 17 surface-contacting mounting surface 19 allows coil component 1001 to be disposed stably on mounting board 119.

Heat is generated due to a current flowing through coil-wire portion 14. The above configuration can dissipate the heat through magnetic core 13 to mounting surface 19 easily. Heat generated in magnetic core 13 due to magnetic flux passing through magnetic core 13 can also be dissipated to mounting surface 19 easily. Thus, the heat can be dissipated efficiently.

Figure 10:
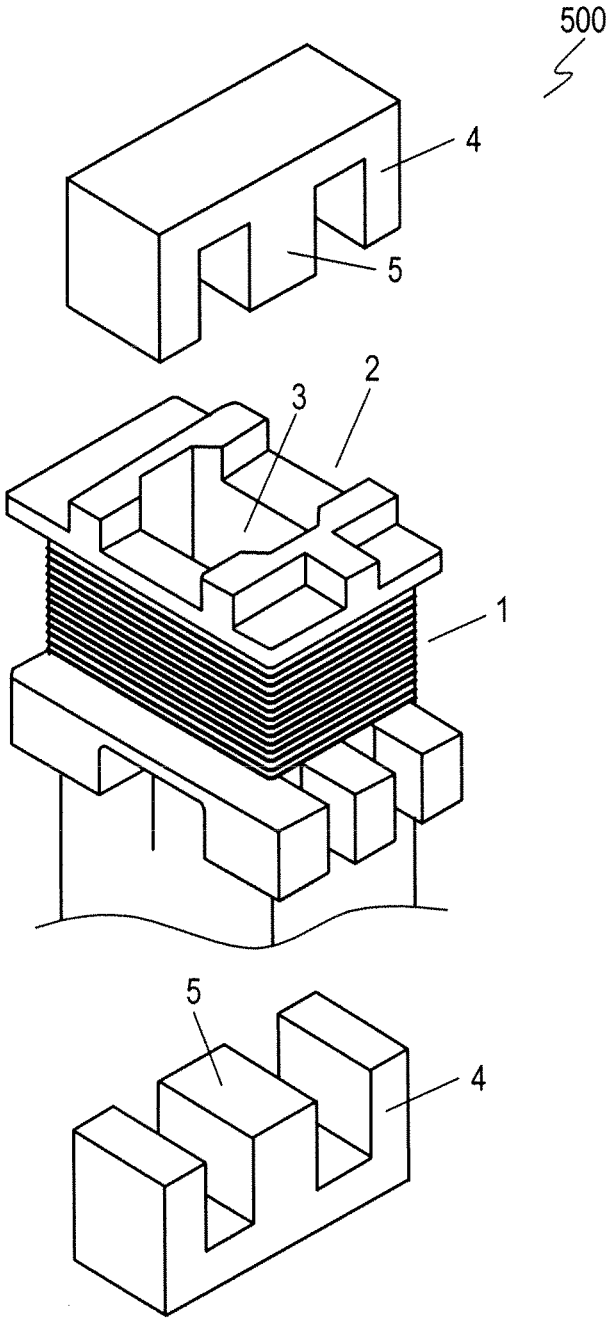
FIG. 10 PRIOR ART
FIG. 10 is an exploded perspective view of the coil component shown in FIG. 9.
Figure 11A:
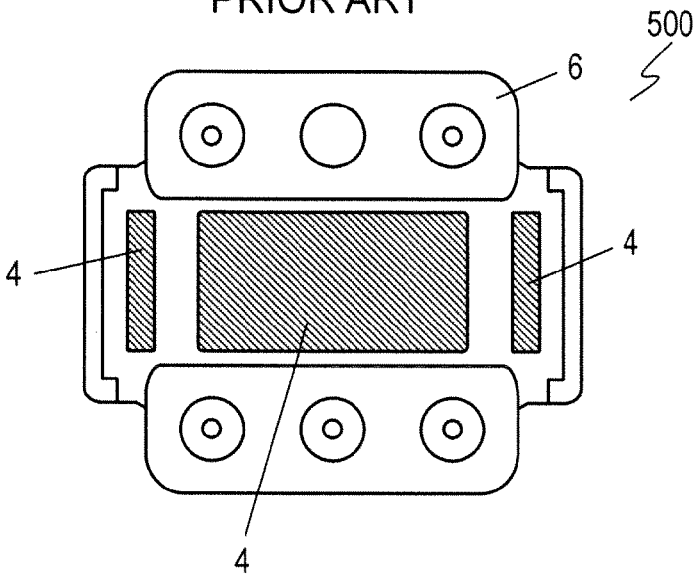
FIG. 11A PRIOR ART
FIG. 11A is a bottom view of the coil component shown in FIG. 10.
Figure 11B:
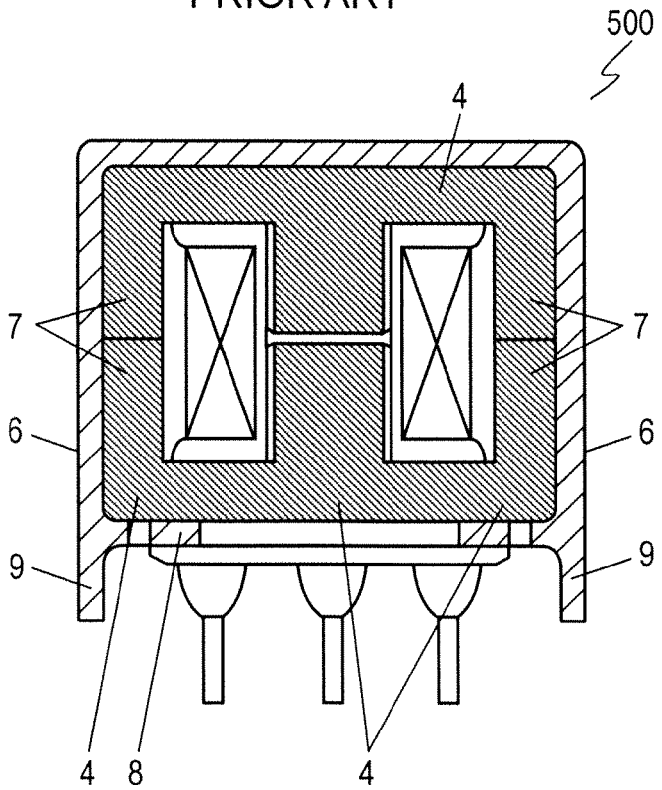
FIG. 11B PRIOR ART
FIG. 11B is a sectional view of the coil component shown in FIG. 11A

In conventional coil component 500 shown in FIG. 10, it is necessary to maintain the force for pressing split magnetic cores 4 each other when split magnetic cores 4 are sealed by a case with split magnetic cores 4 joined to each other. Therefore, as shown in FIGS. 11A and 11B, it is necessary to maintain the state where outer legs 7 of split magnetic cores 4 which are often joined directly without a gap face in close contact with each other. Thus, the region of split core 4 exposed from case 6 corresponds to the position where the pressing force for maintaining the state of outer legs 7 facing each other is applied from a die. The region is inevitably disposed in the vicinity of both ends of split magnetic core 4. When the exposed portion is determined, priority is given not to the region having excellent heat dissipation efficiency but to the production process. Thus, a position where the exposed region is disposed is restricted.

Further, in order to prevent breakage of split magnetic cores 4 caused by a mechanical shock given to split magnetic cores 4 from the outside, for example, the region where split magnetic core 4 is exposed is protected by a difference in level provided between case bottom portion 8 and the exposed region of split magnetic core 4. Alternatively, case extending portions 9 protects split magnetic core 4 from the shock. In this case, the area of a portion of split magnetic core 4 exposed to the air flowing around coil component 500 is small, accordingly reducing the efficiency of heat dissipation.

Granular magnetic material made of powder of soft magnetic material covered with a binder, such as resin, is prepared. The granular magnetic material is pressed to form the pressed magnetic material powder that forms split magnetic cores 113 and 213 (magnetic core 13). The pressed magnetic material powder is excellent in mechanical strength. Thus, even exposed-core portion 18 directly contact mounting surface 19, magnetic core 13 can be protected from breakage due to vibration or shock given from mounting surface 19, ensuring high reliability of coil component 1001.

Since magnetic core 13 is made of the pressed magnetic material powder, a magnetic gap between the lower surface of split middle leg 110 and the upper surface of split middle leg 210 contacting each other is not necessary. In the case that a closed magnetic circuit is formed of the pressed magnetic material powder, micro-pores are provided between the individual magnetic particles forming the pressed magnetic material powder function as a magnetic gap. That is, magnetic characteristics provided by magnetic gaps can be obtained even without a magnetic gap in a spatially concentrated form in a part of the magnetic core. From this viewpoint, when a shock is given to middle leg 10 from mounting surface 19, the pressing force to middle leg 10 can balance with a pressing force applied to outer legs 11 since no space is provided between split middle legs 110 and 210. This configuration prevents a stress from concentrating to a part of magnetic core 13, and prevents deterioration of characteristics caused by breakage or cracks of magnetic core 13.

In the pressed magnetic material powder that forms magnetic core 13, the individual magnetic particles generate heat due to eddy currents generated by magnetic flux passing through magnetic core 13. The region through which a larger amount of magnetic flux passes generates more heat. In magnetic core 13, the magnetic circuit having the magnetic flux flowing therein is short, and thus, has a small magnetic resistance in portions 513 that are closest to coil-wire portion 14 and surrounding coil-wire portion 14. The magnetic flux generated in coil-wire portion 14 tends to concentrate to portions 513 of magnetic core 13, thus generating a large amount of heat. In portions 513, the heat generated in magnetic core 13 tends to be summed with the heat generated in coil-wire portion 14. Portions 512 of connecting rod 212 between middle leg 10 (split middle leg 210) and each of outer legs 11 (split outer legs 211) are disposed between mounting surface 19 and coil-wire portion 14, and overlap portions 513 of magnetic core 13. Thus, portions 512 of connecting rod 212 directly contact mounting surface 19 to significantly enhance the efficiency of heat dissipation.

Figure 4A:
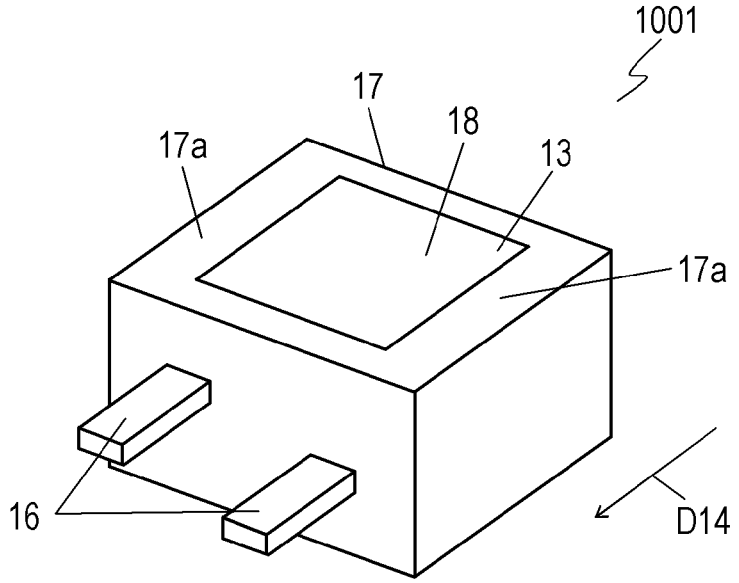
FIG. 4A is a bottom perspective view of the coil component shown in FIG. 1

FIG. 4A is a bottom perspective view of coil component 1001 shown in FIG. 1. As shown in FIG. 4A, exposed-core portion 18 may be preferably disposed at an inner side of lower surface 413 of magnetic core 13 rather than an outer side of lower surface 413 of magnetic core 13. As described above, the portion generating a large amount of heat is located not on the outer side but on the inner side, and thus, the heat dissipation efficiency can be enhanced. Further, case 17 (case bottom portions 17*a*) disposed along the outer periphery of lower surface 413 of magnetic core 13 can prevent magnetic core 13 from dropping off from case 17. Case bottom portions 17*a* extend to lower surface 413 of magnetic core 13 as shown in FIG. 1. This configuration can not only prevent magnetic core 13 from dropping off from case 17 but also stably press split outer legs 111 and 211 in directions causing both split outer legs 111 and 211 to approach each other along case bottom portions 17*a*. This configuration can stabilize the magnetic characteristics of the closed magnetic circuit provided by split magnetic cores 113 and 213.

In FIG. 4A, outer legs 11 are not disposed in direction D14 in which external connecting parts 16 are drawn out from magnetic core 13, and case 17 does not extend to lower surface 413 of magnetic core 13. FIG. 4B is a bottom perspective view of another coil component 1002 in accordance with the embodiment. In FIG. 4B, components identical to those of coil component 1001 shown in FIGS. 1 to 4A are denoted by the same reference numerals. In coil component 1002 shown in FIG. 4B, case bottom portions 17*a* are disposed also in direction D14 in which external connecting parts 16 are drawn out. Since a large amount of heat is generated at the inner side of lower surface 413 of magnetic core 13 than at the outer peripheral side of lower surface 413, this configuration can also reduce the deterioration of heat dissipation and advantageously preventing magnetic core 13 from dropping off from case 17.

Figure 4B:
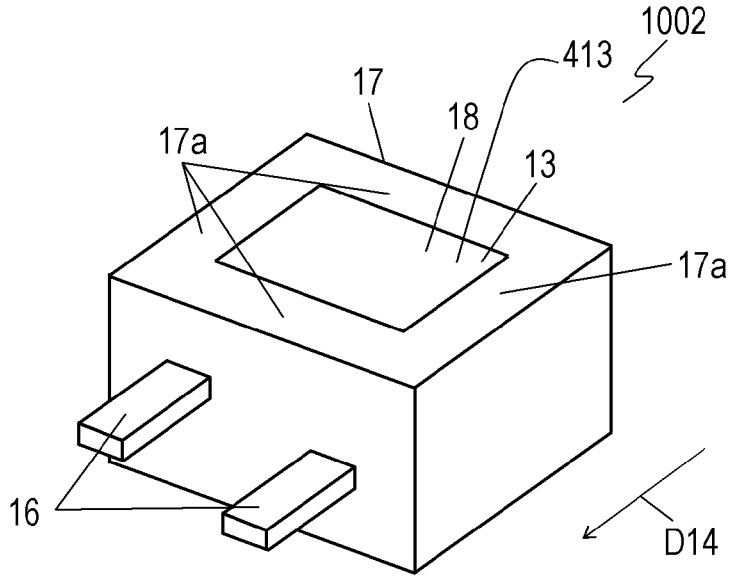
FIG. 4B is a bottom perspective view of another coil component in accordance with the embodiment.
Figure 5:
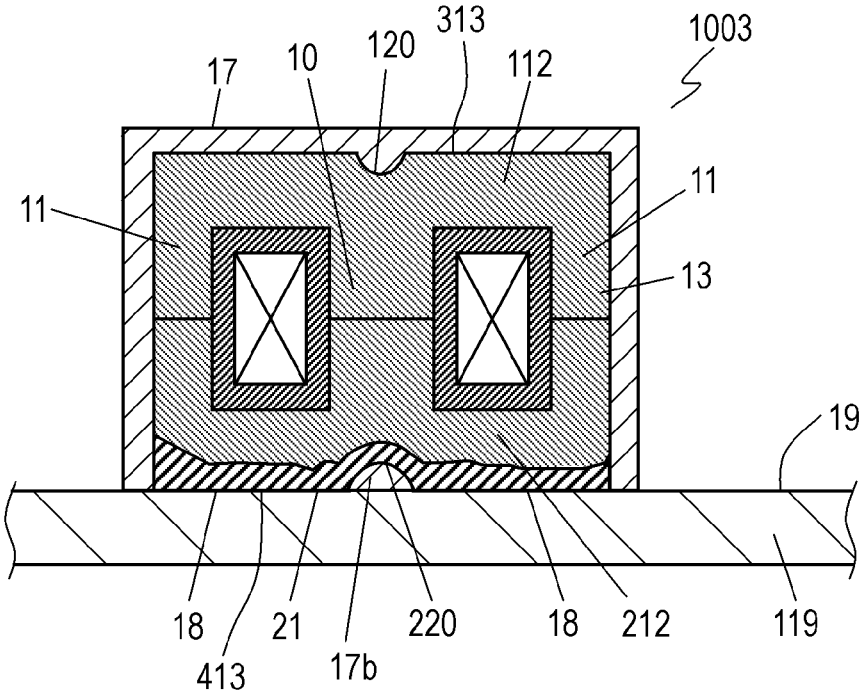
FIG. 5 is a sectional view of still another coil component in accordance with the embodiment.
Figure 6A:
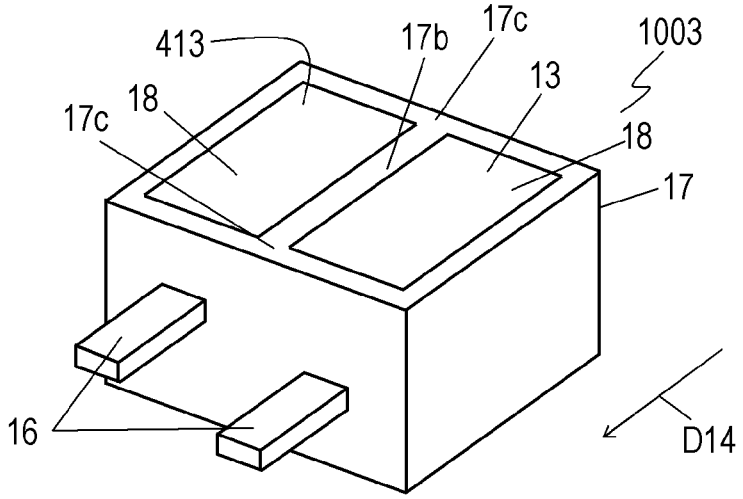
FIG. 6A is a bottom perspective view of the coil component shown in FIG. 5.

FIGS. 5 and 6A are a sectional view and a bottom view of still another coil component 1003 in accordance with the embodiment, respectively. In FIG. 5, components identical to those of coil component 1001 shown in FIGS. 1 to 4A are denoted by the same reference numerals. In coil component 1003 shown in FIG. 5, grooves 120 and 220 are provided in upper surface 313 of magnetic core 13 (split magnetic core 113) and lower surface 413 of magnetic core 13 (split magnetic core 213), respectively. The material of case 17 enters into grooves 120 and 220. Especially, case 17 includes case-crossing portion 17*b* disposed in grove 220 of lower surface 413 exposed from case 17. Case-crossing portion 17*b* is connected to two portions 17*c* of case 17 opposite to each other across lower surface 413 of magnetic core 13, passes under middle leg 10, and extends along lower surface 413 of magnetic core 13. Case 17 of coil component 1003 shown in FIG. 5 does not include case bottom portion 17*a* shown in FIG. 1. Lower surface 413 of magnetic core 13 (split magnetic core 213) has exposed-core portion 18 exposed from case-crossing portion 17*b* of case 17. This configuration can enhance heat dissipation from magnetic core 13 to mounting surface 19, position magnetic core 13 stably with respect to case 17, and prevent magnetic core 13 from dropping off from case 17. In split magnetic core 113, case 17 is formed not only in groove 120 but also entirely covers connecting rod 112.

As shown in FIGS. 5 and 6A, groove 220 is disposed under middle leg 10 and between outer legs 11 while groove 120 is disposed above middle leg 10 between outer legs 11. Case-crossing portion 17*b* is connected to two portions 17*c* of case 17 facing each other across lower surface 413 of magnetic core 13. That is, portions 17*c* are both ends of case-crossing portion 17*b*. Case-crossing portion 17*b* functions as a beam for maintaining the shape of case 17.

As shown in FIG. 6A, case-crossing portion 17*b* disposed on lower surface 413 of magnetic core 13 facilitates close contact between magnetic core 13 and mounting surface 19 in a region which tends to generate large heat to ensure heat dissipation of magnetic core 13, and prevents magnetic core 13 from dropping off from case 17 is prevented. Split magnetic cores 113 and 213 have grooves 120 and 220 in surfaces 313 and 413, respectively. Thus, the split magnetic cores have the same shape, and reduce the thickness of magnetic core 13, i.e. coil component 1003.

Figure 6B:
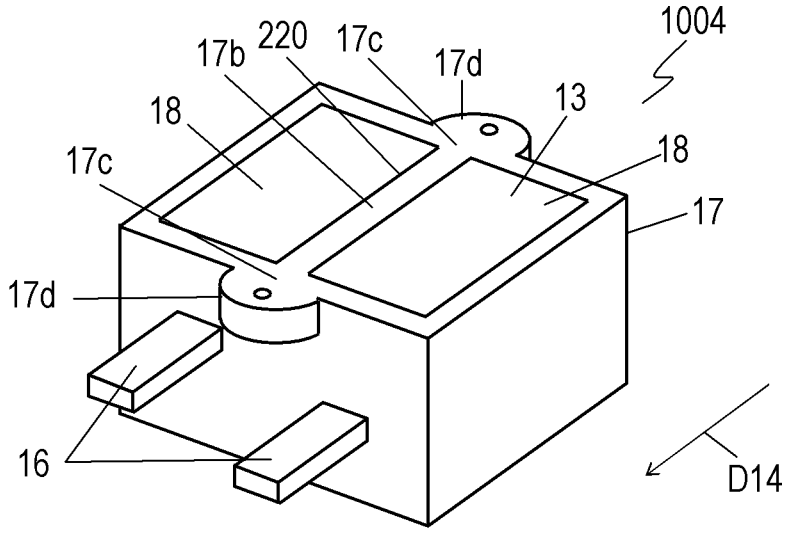
FIG. 6B is a bottom perspective view of a further coil component in accordance with the embodiment.

FIG. 6B is a bottom perspective view of further coil component 1004 in accordance with the embodiment. In FIG. 6B, components identical to those of coil component 1002 shown in FIGS. 5 and 6A are denoted by the same reference numerals. In coil component 1004, case 17 further includes two mounting portions 17*d* disposed at two portions 17*c* of case 17. Mounting portions 17*d* are configured to be fixed to mounting surface 19 (FIG. 5) with a mounting member, such as screws or adhesive agent, thereby fixing case 17, i.e. coil component 1003, onto mounting surface 19.

In the case that case 17 is made of a soft resin, mounting portions 17*d* may be too soft to maintain the positions of mounting portions 17*d* in case 17 stably. In coil component 1004, mounting portions 17*d* are disposed at two portions 17*c*, i.e. both ends of case-crossing portion 17*b* that functions as a beam, thereby stabilizing the positions of mounting portions 17*d* and the shapes of mounting portions 17*d*.

Figure 3:
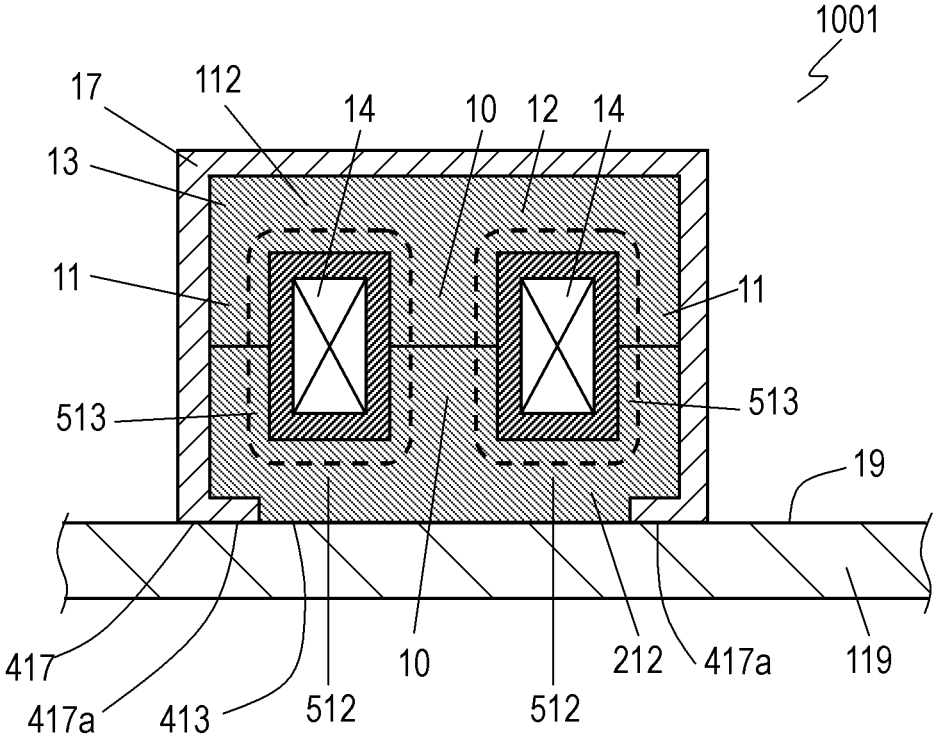
FIG. 3 is a sectional view of the coil component in accordance with the embodiment.

As shown in FIG. 3, the amounts of magnetic flux passing through a portion of connecting rod 212 under middle leg 10 and a portion of connecting rod 112 above middle leg 10 are smaller than those through portions 512. As shown in FIG. 5, grooves 120 and 220 are formed in these portions, and exposed-core portion 18 is disposed symmetrical to each other with respect to groove 220. This configuration can suppress magnetic deterioration. Case-crossing portion 17*b* shown in FIG. 6A is embedded in lower surface 413 of magnetic core 13 and the surface other than lower surface 413 of magnetic core 13 is covered with case 17. This configuration can reduce the thickness of entire coil component 1003 can be reduced while maintaining magnetic characteristics.

Figure 6C:
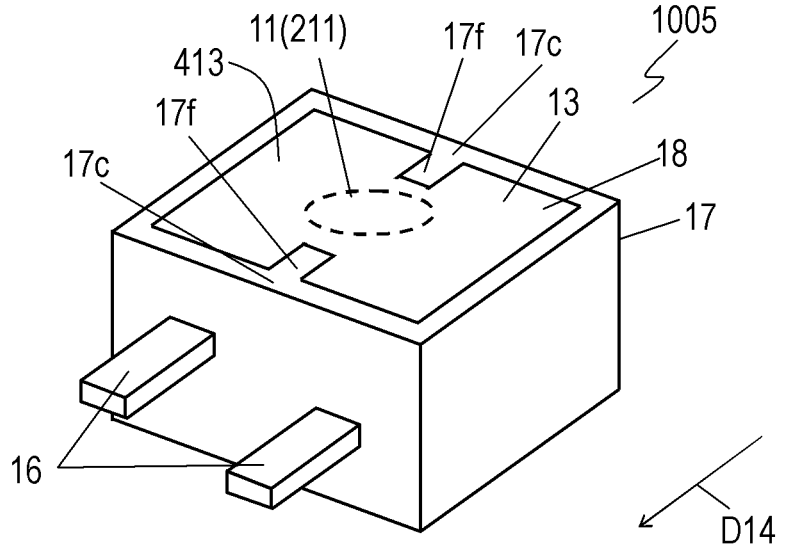
FIG. 6C is a bottom perspective view of a further coil component in accordance with the embodiment.

Case-crossing portion 17*b* extends in direction D14 in which external connecting parts 16 are drawn out, and crosses lower surface 413 of magnetic core 13 so as to connect to two portions of case 17. Case-crossing portion 17*b* does not necessarily cross lower surface 413 of magnetic core 13. FIG. 6C is a bottom perspective view of further coil component 1005 in accordance with the embodiment. In FIG. 6C, components identical to those of coil component 1003 shown in FIGS. 5 and 6A are denoted by the same reference numerals. In coil component 1005 shown in FIG. 6C, instead of case-crossing portion 17*b*, case 17 includes case projections 17*f* projecting from portions 17*c* along lower surface 413 of magnetic core 13. Each of case projections 17*f* projects toward under middle leg 10 from the outer periphery of the case in parallel to direction D14. However, case projection 17*f* does not reach a position under middle leg 10, thus not being disposed under middle leg 10. This configuration does not reduce the volume of magnetic core 13, so that deterioration of magnetic characteristics can be suppressed. This configuration can prevent magnetic core 13 from dropping off from case 17 and increase the area of magnetic core 13 contacting mounting surface 19, accordingly enhancing heat dissipation.

Figure 6D:
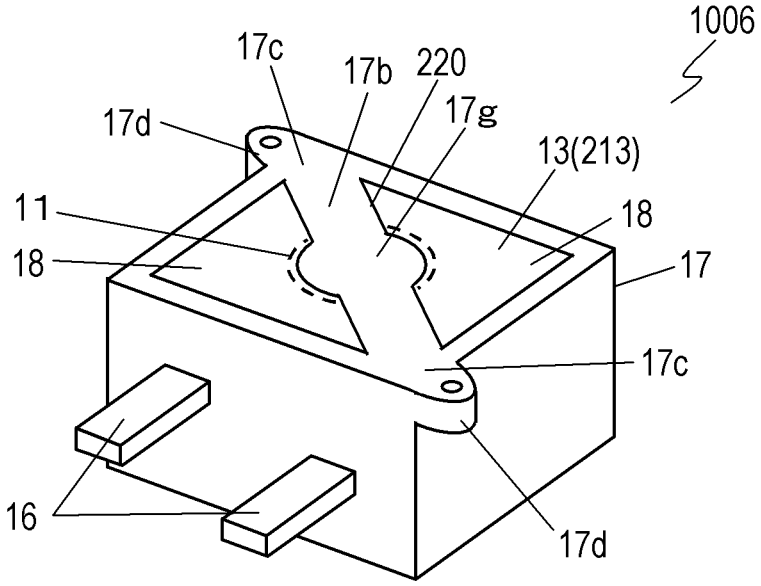
FIG. 6D is a bottom perspective view of a further coil component in accordance with the embodiment.

FIG. 6D is a bottom perspective view of further coil component 1006 in accordance with the embodiment. In FIG. 6D, components identical to those of coil component 1004 shown in FIG. 6B are denoted by the same reference numerals. In coil component 1006 shown in FIG. 6D, groove 220 of magnetic core 13 extends diagonally of lower surface 413. Two portions 17*c* of case 17 are disposed diagonally of lower surface 413 of magnetic core 13, and case-crossing portion 17*b* extends diagonally on lower surface 413 of magnetic core 13. Case-crossing portion 17*b* has wide portion 17*g* that has a locally-larger width. Wide portion 17*g* is disposed under middle leg 10 substantially at the center of case-crossing portion 17*b*. Mounting portions 17*d* are disposed at portions 17*c* of case 17. When case 17 is formed, the resin material of case 17 tends to hardly flow in thin, shallow groove 220 provided in lower surface 413 of the magnetic core, especially at the center thereof. Case-crossing portion 17*b*, i.e. wide portion 17*g* disposed substantially at the center of groove 220, allows the resin to flow smoothly at the center of groove 220.

In coil components 1001 to 1006 according to the embodiment, lower surface 413 of magnetic core 13 is always exposed. When the exposed portion is left for a long time, the surface thereof may be degraded by rusting. In order to suppress the degradation, portions of magnetic core 13, i.e. the portion exposed from case 17, may be preferably impregnated with resin.

For instance, as shown in FIG. 5, in the case that the portion of magnetic core 13 facing mounting surface 19 is exposed, magnetic core 13 is not entirely impregnated with resin, but only a shallow portion near lower surface 413 where magnetic core 13 is exposed is locally impregnated with resin so as to locally form impregnated layer 21. This configuration can suppress degradation and time deterioration of the exposed portion of magnetic core 13. Magnetic characteristics can be deteriorated in impregnated layer 21 of magnetic core 13. However, as shown in FIG. 3, the amount of magnetic flux passing through the portion where magnetic core 13 is exposed is smaller than portions near portions 513. Therefore, the effect of impregnated layer 21 shown in FIG. 5 on the magnetic characteristics of magnetic core 13 is small.

Impregnated layer 21 is disposed locally at the surface of magnetic core 13. Even when the resin that forms impregnated layer 21 degrades and has fluidity under conditions of, e.g. high temperatures, the resin impregnates into a region where magnetic core 13 is not impregnated with the resin, thus being prevented from outflow of the resin from exposed-core portion 18.

Magnetic core 13 may be entirely impregnated with the resin that forms impregnated layer 21. In this case, the mechanical strength of magnetic core 13 can be enhanced.

Figure 7:
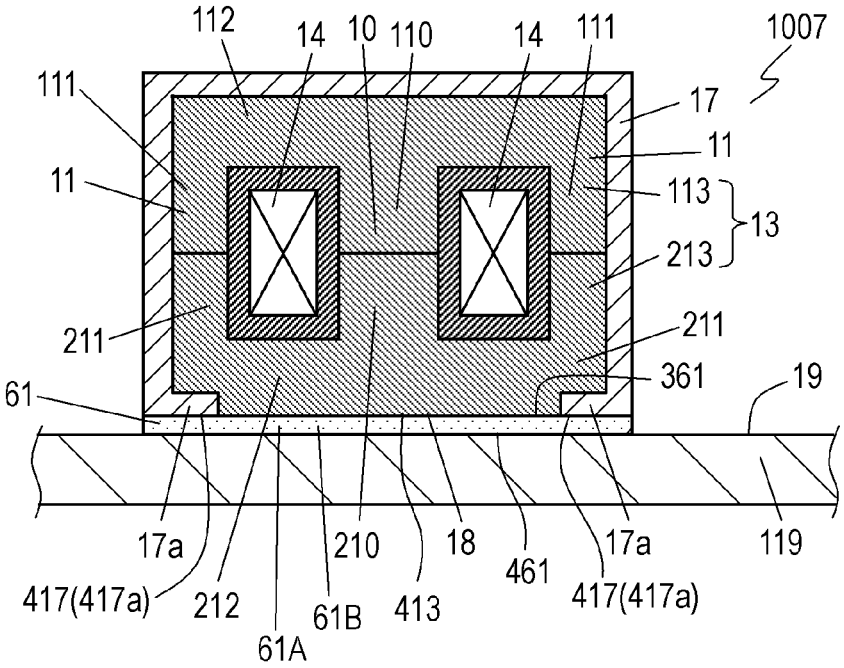
FIG. 7 is a sectional view of a further coil component in accordance with the embodiment.

FIG. 7 is a sectional view of further coil component 1007 in accordance with the embodiment. In FIG. 7, components identical to those of coil component 1001 shown in FIG. 1 are denoted by the same reference numerals. Coil component 1007 further includes supporting layer 61 that has upper surface 361 contacting exposed-core portion 18 of lower surface 413 of magnetic core 13. Supporting layer 61 contains resin 61A and thermally-conductive filler 61B dispersed in resin 61A. Supporting layer 61 is in the form of grease, adhesive agent, potting agent, or a sheet. Filler 61B is made of material, such as metallic material, AlN, BN, $Al_2O_3$, MgO, $SiO_2$, $Mg(OH)_2$, or graphite, that has high thermal conductivity. The metallic material may be Au, Ag, Cu, Ni, or Al. Resin 61A is made of epoxy resin, silicon resin, polyimide resin, or liquid crystal polymer. While coil component 1007 is mounted onto mounting surface 19, lower surface 461 of supporting layer 61 contacts mounting surface 19.

The thermal conductivity of supporting layer 61 is higher than thermal conductivities of the pressed magnetic material powder of magnetic core 13 and case 17. According to the embodiment, the thermal conductivity is not lower than 0.3 W/(m·K), and more preferably, not lower than 2 W/(m·K). The elastic modulus of supporting layer 61 is lower than elastic moduli of the pressed magnetic material powder of magnetic core 13 and case 17. According to the embodiment, the elastic modulus is not higher than 150 GPa, and more preferably, not higher than 50 GPa. For example, lower surface 413 of magnetic core 13 made of the pressed magnetic material powder has fine asperities therein produced by individual magnetic particles. Therefore, the supporting layer having a low elastic modulus allows upper surface 361 of supporting layer 61 to contact exposed-core portion 18 of lower surface 413 of magnetic core 13 without gaps. Further, lower surface 461 of supporting layer 61 can contact mounting surface 19 securely without gaps. This configuration allows the heat of magnetic core 13 to efficiently transmit to mounting surface 19 via supporting layer 61, thus dissipating the heat from coil component 1007 efficiently. The withstanding voltage of supporting layer 61 is higher than withstanding voltages of the pressed magnetic material powder of magnetic core 13 and case 17. According to the embodiment, the withstanding voltage of supporting layer 61 is not lower than 0.1 kV/mm, and more preferably, not lower than 1 kV/mm.

Figure 8:
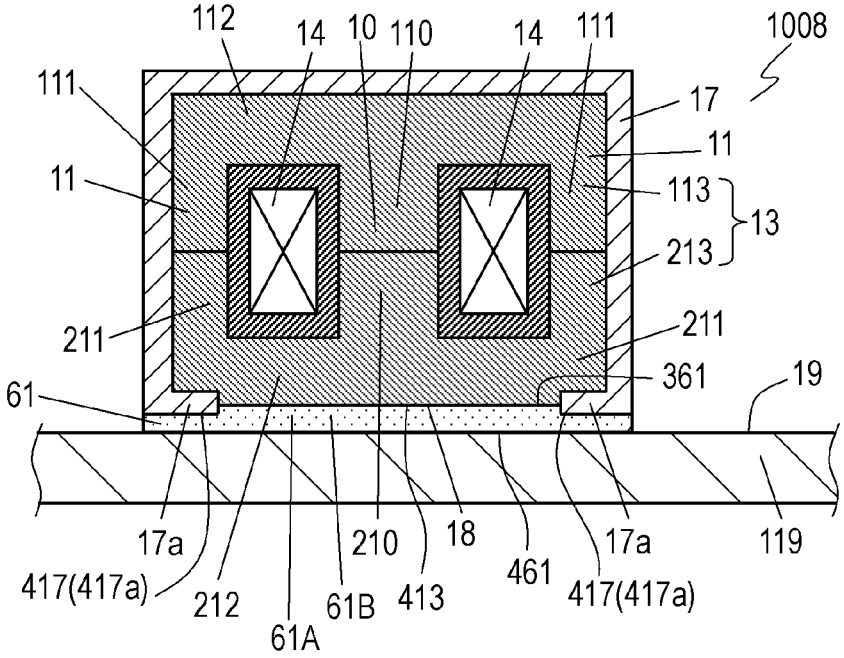
FIG. 8 is a sectional view of a further coil component in accordance with the embodiment.
Figure 9:
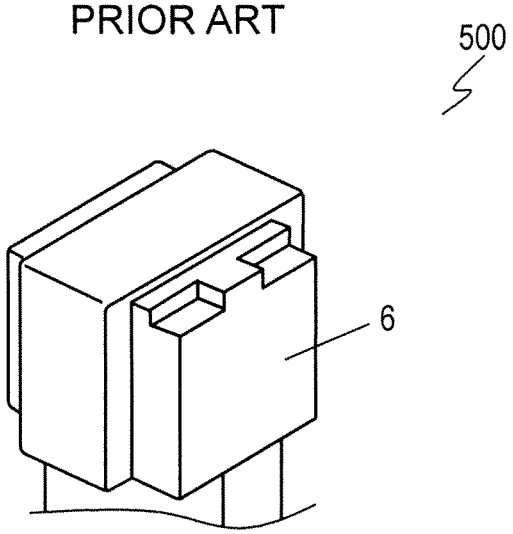
FIG. 9 PRIOR ART
FIG. 9 is a perspective view of a conventional coil component.

FIG. 8 is a sectional view of further coil component 1008 in accordance with the embodiment. In FIG. 8, components identical to those of coil component 1007 shown in FIG. 7 are denoted by the same reference numerals. In coil component 1008, exposed-core portion 18 of lower surface 413 of magnetic core 13 is not flush with lower surface 417 of case 17 (lower surfaces 417*a* of case bottom portions 17*a*), and is hollow. Since supporting layer 61 has a low elastic modulus, the supporting layer can securely contact lower surface 413 of exposed-core portion 18 without gaps even through exposed-core portion 18 of lower surface 413 of magnetic core 13 is not flush with lower surface 417 of case 17 (lower surfaces 417*a* of case bottom portions 17*a*). Therefore, similarly to coil component 1007 shown in FIG. 7, the heat of magnetic core 13 can efficiently transmit to mounting surface 19 via supporting layer 61, thus, dissipating the heat of coil component 1007 efficiently.

Each of coil components 1001 to 1008 according to the embodiment includes single winging portion 14. Plural winging portions 14 may be wound on magnetic core 13 so that the coil component functions as a transformer.

In the embodiment, terms, such as "upper surface", "lower surface", and "lower position", indicating directions merely indicates indicate relative directions depending on relative positional relations between the components, such as a magnetic core, of the coil component, and do not indicate absolute directions, such as a vertical direction.

INDUSTRIAL APPLICABILITY

A coil component according to the present invention maintains excellent heat dissipation and provides high reliability such as shock resistance, and thus is useful for various electronic devices.

REFERENCE MARKS IN THE DRAWINGS

10 Middle Leg
11 Outer Leg
13 Magnetic Core
14 Coil-Wire Portion
17 Case
17*a* Case Bottom Portion
17*b* Case-Crossing Portion
18 Exposed-Core Portion (First Exposed-Core Portion, Second Exposed-Core Portion)
19 Mounting Surface
21 Impregnated Layer
61 Supporting Layer
212 Connecting Rod

The invention claimed is:

1. A coil component configured to be mounted onto a mounting surface, said coil component comprising:

a magnetic core including a middle leg, an outer leg, and a connecting rod that connects the middle leg and the outer leg, the magnetic core being made of pressed magnetic material powder, the magnetic core forming a closed magnetic circuit;

a coil-wire portion wound on the middle leg of the magnetic core; and a case made of a resin covering the magnetic core and the coil-wire portion, wherein the magnetic core has a lower surface configured to face the mounting surface while the coil component is mounted onto the mounting surface, wherein the case has a lower surface configured to face the mounting surface while the coil component is mounted onto the mounting surface, wherein the lower surface of the magnetic core has a first exposed-core portion exposed from the case, and wherein the first exposed-core portion is flush with the lower surface of the case, wherein the case includes a case-crossing portion connected to two portions of the case which face each other across the lower surface of the magnetic core, the case-crossing portion passing through under the middle leg and extending along the lower surface of the magnetic core, wherein the lower surface of the magnetic core further includes a second exposed-core portion exposed from the case, and wherein the first exposed-core portion and the second exposed-core portion are disposed symmetrical to each other with respect to the case-crossing portion.

2. The coil component according to claim 1, wherein the connecting rod includes the lower surface of the magnetic core, and wherein the middle leg and the outer leg extend upward from the connecting rod.

3. The coil component according to claim 1, wherein the lower surface of the case and the first exposed-core portion are configured to surface-contact the mounting surface.

4. The coil component according to claim 1, wherein the case includes a case bottom portion extending along the lower surface of the magnetic core.

5. The coil component according to claim 4, wherein the case bottom portion is disposed under the outer leg.

6. The coil component of claim 1, wherein the first exposed-core portion is disposed under the coil-wire portion.

7. The coil component according to claim 1, wherein the case includes a plurality of mounting portions for fixing the case to the mounting surface, each of the plurality of mounting portions being disposed at respective one of the two portions of the case.

8. The coil component according to claim 1, wherein the case-crossing portion includes a wide portion having a width which is locally larger.

9. The coil component according to claim 1, wherein the first exposed-core portion has an impregnated portion that is locally impregnated with a resin.

10. The coil component according to claim 1, further comprising a supporting layer contacting the first exposed-core portion, wherein the supporting layer contains a resin and thermally-conductive filler dispersed in the resin, and wherein a lower surface of the supporting layer is configured to contact the mounting surface while the coil component is mounted onto the mounting surface.

11. The coil component according to claim 10, wherein a thermal conductivity of the supporting layer is higher than thermal conductivities of the pressed magnetic material powder and the case.

12. The coil component according to claim 10, wherein an elastic modulus of the supporting layer is lower than elastic moduli of the pressed magnetic material powder and the case.

13. The coil component according to claim 10, wherein a withstanding voltage of the supporting layer is higher than withstanding voltages of the pressed magnetic material powder and the case.

14. The coil component according to claim 2, wherein the lower surface of the case and the first exposed-core portion are configured to surface-contact the mounting surface.

15. The coil component according to claim 2, wherein the case includes a case bottom portion extending along the lower surface of the magnetic core.

16. The coil component according to claim 15, wherein the case bottom portion is disposed under the outer leg.

17. The coil component of claim 2, wherein the first exposed-core portion is disposed under the coil-wire portion.

18. A coil component configured to be mounted onto a mounting surface, said coil component comprising:

a magnetic core including a middle leg, an outer leg, and a connecting rod that connects the middle leg and the outer leg, the magnetic core being made of pressed magnetic material powder, the magnetic core forming a closed magnetic circuit;

a coil-wire portion wound on the middle leg of the magnetic core; and a case made of a resin covering the magnetic core and the coil-wire portion, wherein the magnetic core has a lower surface configured to face the mounting surface while the coil component is mounted onto the mounting surface, wherein the case has a lower surface configured to face the mounting surface while the coil component is mounted onto the mounting surface, wherein the lower surface of the magnetic core has a first exposed-core portion exposed from the case, and wherein the first exposed-core portion is flush with the lower surface of the case, wherein the connecting rod includes the lower surface of the magnetic core, wherein the middle leg and the outer leg extend upward from the connecting rod, wherein the case includes a case-crossing portion connected to two portions of the case which face each other across the lower surface of the magnetic core, the case-crossing portion passing through under the middle leg and extending along the lower surface of the magnetic core, wherein the lower surface of the magnetic core further includes a second exposed-core portion exposed from the case, and wherein the first exposed-core portion and the second exposed-core portion are disposed symmetrical to each other with respect to the case-crossing portion.

19. The coil component according to claim 18, wherein the case includes a plurality of mounting portions for fixing the case to the mounting surface, each of the plurality of mounting portions being disposed at respective one of the two portions of the case.

20. The coil component according to claim 18, wherein the case-crossing portion includes a wide portion having a width which is locally large.

21. The coil component according to claim 2, wherein the first exposed-core portion has an impregnated portion that is locally impregnated with a resin.

22. The coil component according to claim 2, further comprising a supporting layer contacting the first exposed-core portion, wherein the supporting layer contains a resin and thermally-conductive filler dispersed in the resin, and wherein a lower surface of the supporting layer is configured to contact the mounting surface while the coil component is mounted onto the mounting surface.

23. The coil component according to claim 22, wherein a thermal conductivity of the supporting layer is higher than thermal conductivities of the pressed magnetic material powder and the case.

24. The coil component according to claim 22, wherein an elastic modulus of the supporting layer is lower than elastic moduli of the pressed magnetic material powder and the case.

25. The coil component according to claim 22, wherein a withstanding voltage of the supporting layer is higher than withstanding voltages of the pressed magnetic material powder and the case.

* * * * *